US008086157B2

(12) United States Patent
Hamahashi

(10) Patent No.: US 8,086,157 B2
(45) Date of Patent: Dec. 27, 2011

(54) IMAGE FORMING APPARATUS INCLUDING STORAGE DEVICE STORING MAXIMUM LENGTH OF TRANSFERRING MEDIUM

(75) Inventor: Shunsuke Hamahashi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 398 days.

(21) Appl. No.: 12/348,338

(22) Filed: Jan. 5, 2009

(65) Prior Publication Data

US 2009/0190973 A1 Jul. 30, 2009

(30) Foreign Application Priority Data

Jan. 25, 2008 (JP) ..... 2008-015488

(51) Int. Cl.
*G03G 15/01* (2006.01)

(52) U.S. Cl. ..... 399/302; 399/308

(58) Field of Classification Search ..... 399/302, 399/308

See application file for complete search history.

(56) References Cited

U.S. PATENT DOCUMENTS

| | | | | |
|---|---|---|---|---|
| 5,410,392 | A * | 4/1995 | Landa | 399/308 |
| 6,088,565 | A * | 7/2000 | Jia et al. | 399/302 |
| 2002/0122679 | A1 * | 9/2002 | Omata et al. | 399/309 |
| 2004/0184846 | A1 * | 9/2004 | Murata | 399/328 |
| 2005/0254855 | A1 * | 11/2005 | Inaba et al. | 399/113 |
| 2007/0071511 | A1 * | 3/2007 | Suzuki et al. | 399/307 |
| 2007/0172257 | A1 * | 7/2007 | Matsuda et al. | 399/301 |
| 2007/0212126 | A1 * | 9/2007 | Seto et al. | 399/302 |
| 2007/0212141 | A1 | 9/2007 | Hamahashi | |
| 2007/0253753 | A1 * | 11/2007 | Yamaji et al. | 399/302 |
| 2008/0048392 | A1 | 2/2008 | Hamahashi | |
| 2008/0069610 | A1 * | 3/2008 | Nakafuji et al. | 399/329 |

FOREIGN PATENT DOCUMENTS

| | | |
|---|---|---|
| JP | 02-259670 | 10/1990 |
| JP | 09-211900 | 8/1997 |
| JP | 2002-189358 | 7/2002 |

* cited by examiner

*Primary Examiner* — Ryan Walsh
(74) *Attorney, Agent, or Firm* — IPUSA, PLLC

(57) ABSTRACT

An image forming apparatus includes a latent image forming part configured to form a latent image on an image carrier; a developing part configured to form a toner image by developing the latent image on the image carrier; a first transferring part configured to transfer the toner image on the image carrier to a surface of a transferring medium or a first intermediate transferring part; a second transferring part configured to transfer the toner image on the first intermediate transferring part onto a second intermediate transferring part; a third transferring part configured to transfer the toner image on the second intermediate transferring part onto a third intermediate transferring part; and a fourth transferring part configured to transfer the toner image on the third intermediate transferring part onto a rear surface of the transferring medium.

10 Claims, 3 Drawing Sheets

IMAGE FORMING APPARATUS INCLUDING STORAGE DEVICE STORING MAXIMUM LENGTH OF TRANSFERRING MEDIUM

BACKGROUND OF THE INVENTION

1. Field of the Invention

The present invention generally relates to image forming apparatuses.

2. Description of the Related Art

Conventionally, a switch-back method and a one-pass method have been known as methods for forming images on both surfaces of a transferring medium such as a copy paper in an electrophotographic image forming apparatus. In the switch-back method, after an image formed on a surface by a transferring part is fixed by a fixing part, the transferring medium is reversed (switched back) and then transferring and fixing are performed on the opposite side surface (rear surface) so that an image is formed on the opposite side surface. On the other hand, in the one-pass method, after images are transferred onto both surfaces by a both-surfaces transferring part, the transferring medium is provided at the fixing part. Hence, the images can be formed on both surfaces of the transferring medium without switching back the transferring medium.

The one-pass method is superior to the switch back method in the following points. In other words, in the one-pass method, cost increases due to providing the complex switch back mechanism for reversing the transferring medium can be avoided. Furthermore, in the one-pass method, generation of jams due to a long interval for image forming by the switch back method and switching back of the transferring medium which is curled by heat of the heating part can be avoided.

The following apparatuses have been known as examples of an image forming apparatus for one-pass both-surfaces printing, the apparatus not requiring a both-surfaces reversing mechanism or a both-surfaces conveyance path.

For example, Japanese Laid-Open Patent Application Publication No. 2002-189358 describes an image forming apparatus having a first intermediate transferring belt and a second intermediate transferring belt. A transferring medium such as a printing paper can be transferred by the second intermediate transferring belt. A toner image on the first intermediate transferring belt can be transferred by the second intermediate transferring belt.

Japanese Laid-Open Patent Application Publication No. 2-259670 describes an image forming apparatus whereby a pair of photosensitive members for individually forming toner images having different electrostatic charge properties is used so that the toner images are transferred onto both surfaces of a transferring sheet.

Japanese Laid-Open Patent Application Publication No. 9-211900 describes an image forming apparatus whereby toner images are formed on both surfaces of a transferring sheet by using an individual intermediate transferring belt which holds a rear surface image of each color and a contact and un-contact mechanism between the intermediate transferring belt and a photosensitive member.

As discussed above, although the one-pass image forming apparatuses have been suggested, there are points to be improved such as the speed of image forming, miniaturization or low price of the apparatus, and the quality of a formed image.

For example, in the image forming apparatus described in Japanese Laid-Open Patent Application Publication No. 2002-189358, after the toner image on the rear surface is transferred onto the second intermediate transferring belt, the transferring medium is stacked on the intermediate transferring belt where the toner image is transferred so as to be carried. Accordingly, the toner image of the rear surface on the intermediate transferring belt and the transferring member are rubbed so that quality degradation of the image may occur. Furthermore, conveyance of the toner image by lengths of two intermediate transferring belts until the rear surface is transferred is necessary so that the printing time becomes long.

In addition, in the image forming apparatus described in Japanese Laid-Open Patent Application Publication No. 2-259670, a pair of photosensitive members or a developing unit is necessary for forming the toner image on a surface or a rear surface. Hence, there is an increase of cost due to the increase in the number of components or the large size of the apparatus.

Furthermore, in the image forming apparatus described in Japanese Laid-Open Patent Application Publication No. 9-211900, there are four intermediate transferring belts for black (Bk), magenta (M), cyan (C), and yellow (Y) colors. Therefore, there is a problem where color adjustment is difficult, in addition to an increase in cost due to an increase in the number of components or in the large size of the apparatus.

SUMMARY OF THE INVENTION

Accordingly, embodiments of the present invention may provide a novel and useful image forming apparatus solving one or more of the problems discussed above.

More specifically, the embodiment of the present invention may provide an image forming apparatus whereby it is possible to form a high quality image on both surfaces of the transferring medium by a one-pass method and to realize simplification of the apparatus.

One aspect of the embodiment of the present invention may be to provide an image forming apparatus, including a latent image forming part configured to form a latent image on an image carrier; a developing part configured to form a toner image by developing the latent image on the image carrier; a first transferring part configured to transfer the toner image on the image carrier to a surface of a transferring medium or a first intermediate transferring part; a second transferring part configured to transfer the toner image on the first intermediate transferring part onto a second intermediate transferring part; a third transferring part configured to transfer the toner image on the second intermediate transferring part onto a third intermediate transferring part; and a fourth transferring part configured to transfer the toner image on the third intermediate transferring part onto a rear surface of the transferring medium; wherein the first intermediate transferring part and the second intermediate transferring part are belt shaped; the third intermediate transferring part is roller shaped; and the fourth transferring part is provided at a downstream side of the first transferring part on a conveyance path of the transferring medium.

Another aspect of the embodiment of the present invention may be to provide an image forming apparatus, including latent image forming means for forming a latent image on an image carrier; developing means for forming a toner image by developing the latent image on the image carrier; first transferring means for transferring the toner image on the image carrier to a surface of a transferring medium or a first intermediate transferring part; second transferring means for transferring the toner image on the first intermediate transferring part onto a second intermediate transferring part; third transferring means for transferring the toner image on the second intermediate transferring part onto a third intermediate transferring part; and fourth transferring means for transferring the toner image on the third intermediate transferring part onto a rear surface of the transferring medium; wherein the first intermediate transferring part and the second intermediate transferring part are belt shaped; the third intermediate transferring part is roller shaped; and the fourth transferring means is provided at a downstream side of the first transferring means on a conveyance path of the transferring medium.

Additional objects and advantages of the embodiments of the invention will be set forth in part in the description which follows, and in part will become obvious from the description, or may be learned by practice of the invention. The object and advantages of the embodiments of the invention will be realized and attained by means of the elements and combinations particularly pointed out in the appended claims.

It is to be understood that both the foregoing general description and the following detailed description are exemplary and explanatory only and are not restrictive of the invention as claimed.

DETAILED DESCRIPTION OF THE PREFERRED EMBODIMENTS

Figure 1:
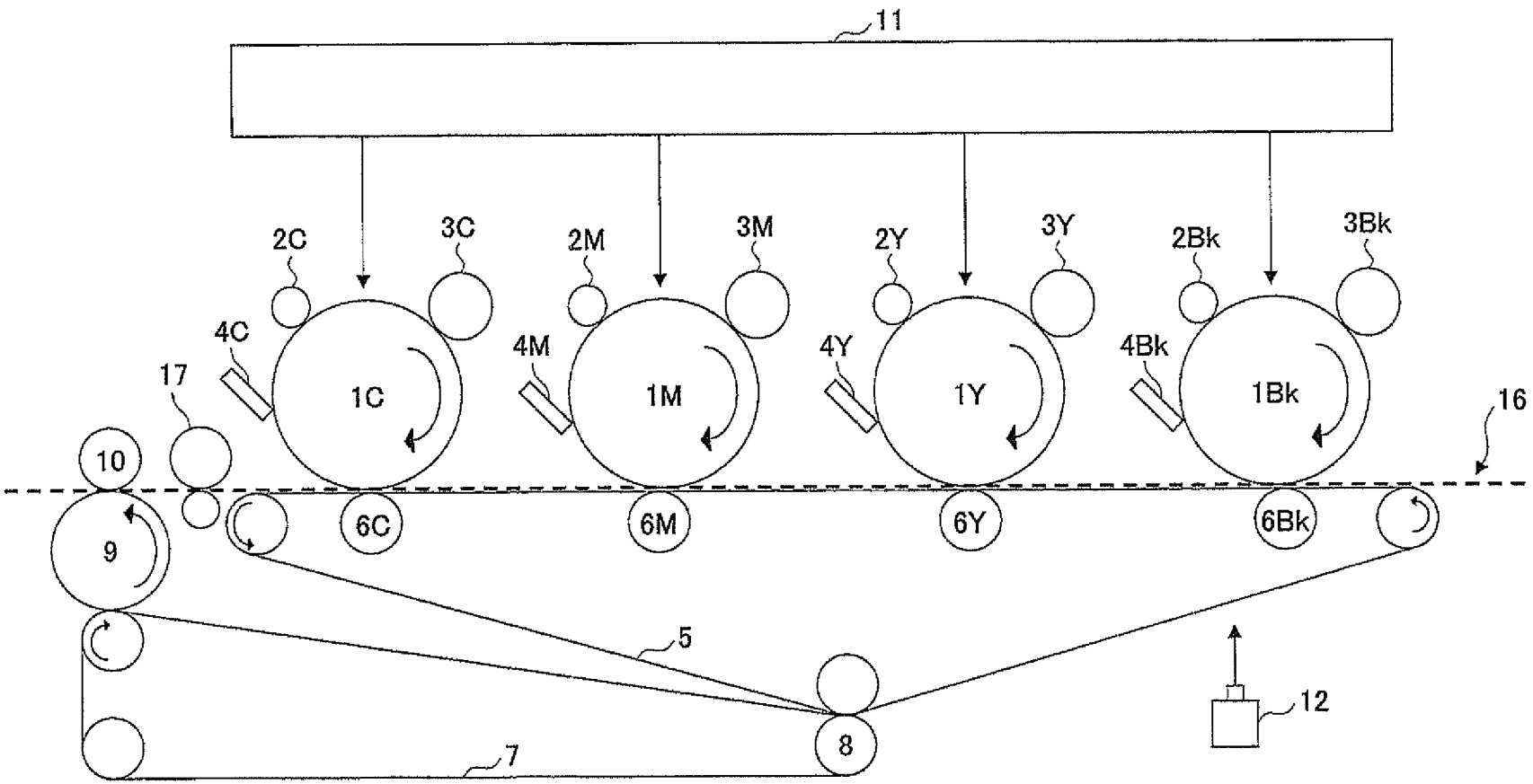
FIG. 1 is a schematic structural view of an image forming apparatus of an embodiment of the present invention.

A description is given below, with reference to the FIG. 1 through FIG. 3 of embodiments of the present invention.

First, a basic structure of an image forming apparatus of an embodiment of the present invention is discussed with reference to FIG. 1. Here, FIG. 1 is a schematic structural view of the image forming apparatus of the embodiment of the present invention.

The image forming apparatus of the embodiment of the present invention has four process cartridges including photosensitive bodies 1Bk, 1Y, 1M, and 1C. The photosensitive bodies 1Bk, 1Y, 1M, and 1C are configured to form toner images of black (Bk), yellow (Y), magenta (M), and cyan (C). These photosensitive bodies 1Bk, 1Y, 1M, and 1C use different color (Bk, Y, M and C) toners as image forming materials. These photosensitive bodies 1Bk, 1Y, 1M, and 1C have the same structures other than the image forming materials. The photosensitive bodies 1Bk, 1Y, 1M, and 1C can be exchanged at the time of their end of service life. The image forming apparatus of the embodiment of the present invention can be used for single color image forming or for two colors, three colors, or five or more colors image forming.

In the following explanations, the process cartridge for forming a Bk toner image is discussed as an example.

The process cartridge for forming the Bk toner image includes a drum shaped photosensitive body 1Bk as a image carrier, an electrostatic charge device 2Bk, a developing device 3Bk, a drum cleaning device 4Bk, an exposure device 11, and others.

The photosensitive body 1Bk has a structure where a aluminum cylinder having a diameter of 25 mm through 100 mm is covered with a surface layer made of an organic semiconductor material as a photoconductive material. The surface layer may be made of amorphous silicon. The photosensitive body 1Bk may be not drum-shaped but belt-shaped.

The electrostatic charge device 2Bk such as an electrostatic charge roller is configured to charge a surface of the photosensitive body 1Bk. The photosensitive body 1Bk is rotated clockwise in FIG. 1 by a driving part not illustrated in FIG. 1. The surface of the photosensitive body 1Bk which is charged equally is exposed and scanned by a laser light irradiated from the exposure device 11 as an image information writing unit so that a Bk electrostatic latent image is formed.

The Bk electrostatic latent image is developed into a Bk toner image by the developing device 3Bk using the Bk toner. The Bk toner image developed on the photosensitive body 1Bk is transferred to a surface of a transferring medium by a first transferring roller 6Bk as a first transferring part or a primary transfer is performed on a first intermediate transferring part 5.

A position where the Bk toner image is transferred by the first transferring roller 6Bk is a first transferring part. Whether to perform transferring on the surface of the transferring medium or the primary transferring on the first intermediate transferring part 5 is determined based on whether the transferring medium has been conveyed to the first transferring part on the conveyance path.

The drum cleaning device 4Bk is configured to remove the toner remaining on the surface of the photosensitive body 1Bk after the Bk toner image is transferred by the first transferring part. At this time, residual toner received by the drum cleaning device 4Bk may be returned to the developing device 3Bk so as to be reused.

In addition, a charge eliminating device not illustrated in FIG. 1 may be provided in the image forming apparatus. The charge eliminating device is configured to eliminate a charge remaining on the photosensitive body 1Bk after the residual charge is removed. The surface of the photosensitive body 1Bk is initialized by this charge elimination in preparing next image forming.

In other process cartridges Y, M, and C, the Y, M, and C toner images are formed on the photosensitive bodies 1Y, 1M, and 1C, respectively, so as to be transferred onto the surface of the transferring medium or the first intermediate transferring part 5.

In an image data processing apparatus, an exposure scanning control signal is generated based on an image information signal transferred from a personal computer or the like so as to be transferred to the exposure device 11.

The exposure device 11 as a latent image forming part irradiates a laser light to be transmitted, based on the exposure scanning control signal, to each of the photosensitive bodies 1Bk, 1Y, 1M and 1C of the process cartridges. Electrostatic latent images for Bk, Y, M, and C are formed on the respective photosensitive bodies 1Bk, 1Y, 1M and 1C which are exposed by the irradiation.

The exposure device 11 scans the laser light emitting from the light source by a polygon mirror rotated by a motor and transmits the laser light to the photosensitive bodies 1Bk, 1Y, 1M and 1C via plural optical lenses or mirrors.

Instead of the exposure device 11 having the above-mentioned structure, an exposure part configured to irradiate an LED light from an LED array may be used.

The first intermediate transferring part 5 is provided under the photosensitive bodies 1Bk, 1Y, 1M and 1C. The first intermediate part 5 is formed of a first transferring belt which is an endless moving belt wound around rollers. The intermediate transferring part 5 comes in contact with the photosensitive bodies 1Bk, 1Y, 1M and 1C so as to be rotated with the photosensitive bodies 1Bk, 1Y, 1M and 1C.

Locations where the first intermediate part 5 comes in contact with the photosensitive bodies 1Bk, 1Y, 1M and 1C are first transferring parts. Four transferring rollers 6Bk, 6Y, 6M, and 6C corresponding to the photosensitive bodies 1Bk, 1Y, 1M and 1C, in addition to the first transferring belt 5, are arranged in the corresponding first transferring part. The transferring rollers 6Bk, 6Y, 6M, and 6C are rotated with the first transferring belt 5.

The first transferring belt 5 is sandwiched by the transferring rollers 6Bk, 6Y, 6M, and 6C and the photosensitive bodies 1Bk, 1Y, 1M and 1C so that corresponding primary transferring nips are formed. For a transfer method in these nips a primary transferring bias having a polarity reversed against the polarity of the toner is applied to the rear surface (loop internal circumferential surface) of the first transferring belt 5. This may be a charger method wherein an electrode is discharged.

In a case where the toner images on the photosensitive bodies 1Bk, 1Y, 1M and 1C are transferred to the surface of the transferring medium, while the transferring medium is conveyed on the conveyance path 16, the Bk, Y, M and C toner images formed on the photosensitive bodies 1Bk, 1Y, 1M and 1C are superposed on the surface of the transferring medium in order by adjustment of the primary transferring bias strength using the first transferring part of the photosensitive bodies 1Bk, 1Y, 1M and 1C. As a result of this, the toner images (four color toner images) formed by superposing four colors are formed on the surface of the transferring medium.

On the other hand, in a case of transferring to the rear surface of the transferring medium, the Bk, Y, M and C toner images formed on the four photosensitive bodies 1Bk, 1Y, 1M and 1C undergo primary transfer onto the first transferring belt 5 by adjusting the primary transferring bias by each of the first transferring parts. In this case, the transferring medium is not conveyed to the first transferring parts on the conveyance path 16.

The first transferring belt 5 has electrical resistance conditions proper for performing electrostatic transferring by the first transferring bias. More specifically, the first transferring belt 5 having an entire volume resistivity of $10^6$ Ωcm through $10^{14}$ Ωcm has a structure where a surface layer made of a low surface energy material is coated, if necessary, on a belt base body made of a resin film or rubber and having a thickness of approximately 50 μm through 1000 μm.

The first transferring belt 5 passes through the primary transferring nip of each of the primary transferring parts for Bk, Y, M, and C based on the endless moving. Four Bk, Y, M, and C toner images individually formed on the four photosensitive bodies 1Bk, 1Y, 1M and 1C are superposed on the first transferring belt 5 as a four color toner image.

Here, the first transferring rollers 6Bk, 6Y, 6M, and 6*c* are metal rollers or rollers where cored bars are covered with conductive rubber or sponge layers. The primary transferring biases having polarities reversed against the polarities of the toners are applied by an electric power source not illustrated in FIG. 1.

An endless second transferring belt 7 as a second intermediate transferring part is provided under the first transferring belt 5. The second transferring belt 7 is provided so as to come in contact and be rotated with the first transferring belt 5. At the contact part, not only the second transferring belt 7 but also the second transferring roller 8 as a second transferring part is arranged so as to be rotated with the second transferring belt 7.

The second transferring belt 7 is sandwiched by the second transferring roller 8 and the first transferring belt 5 so that a secondary transferring nip is formed. A secondary transferring bias having a polarity reversed against the polarity of the toner is applied to the second transferring belt 7 side. This position is a second transferring part. The second transferring belt 7 has conditions proper for performing electrostatic transferring by the second transferring bias. Thus, four color toner images formed on the first transferring belt 5 undergo secondary transfer onto the second transferring belt 7.

Four color toner images which are visible images formed on the first transferring belt 5 undergo secondary transfer onto the second transferring belt 7 at the secondary transferring nip. Residual toner which is not transferred onto the second transferring belt 7 may be adhered on the first transferring belt 5 after the first transferring belt 5 passes through the secondary transferring nip. A method of removing the residual toner on the intermediate transferring part is illustrated in FIG. 2. Here, FIG. 2 is a schematic view showing cleaning of an intermediate transferring part in the image forming apparatus of the embodiment of the present invention.

Figure 2:
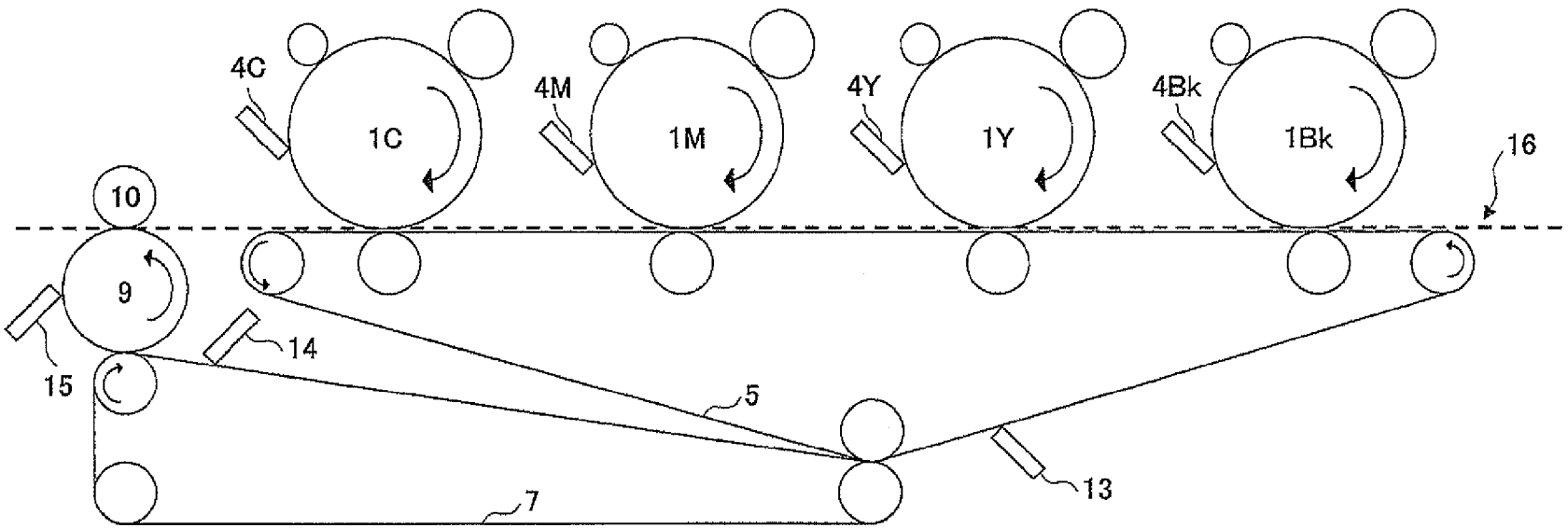
FIG. 2 is a schematic view showing cleaning of an intermediate transferring part in the image forming apparatus of an embodiment of the present invention.

As shown in FIG. 2, the residual toner which is not transferred but adheres on the first transferring belt 5 is removed by a cleaning device 13 of the intermediate transferring part. The cleaning device 13 is provided downstream of the second transferring part. Here, the cleaning device 13 of the intermediate transferring part may be a mechanical cleaner such as a cleaning blade or an electrostatic cleaner.

The toner removed by cleaning may be reused. In the case of the four color toner images, the four color toners are mixed; the mixed toner cannot be used as it is.

Referring back to FIG. 1, an optical sensor 12 as a toner image detecting part is provided at the downstream of the second transferring part of the first transferring belt 5. The optical sensor 12 is configured to detect the relative relationship and density of the four color toner images on the first transferring belt 5. Based on the relative positional relationship of the four color toner images detected by the optical sensor 12, a color shift adjustment for adjusting a color shift of each color is performed. Density adjustment for adjusting the amount of adhered toner of each color based on the density of each color of the four color toner image can be performed.

A third intermediate transferring part 9 is provided to the left and above the second transferring belt 7. The roller shaped third intermediate part (third transferring roller) 9 comes in contact with the second transferring belt 7 so as to be rotated with the second transferring belt 7. The third intermediate part 9 is rotated counterclockwise in the example shown in FIG. 1.

A tertiary transferring nip is formed by contact of the third intermediate transferring part 9 as the third transferring part with the second transferring belt 7. A position of the tertiary transferring nip is a third transferring part. A tertiary bias having a polarity reversed against the polarity of the toner is applied to the third intermediate transferring part 9 side.

The third intermediate transferring part 9 has conditions proper for performing electrostatic transferring by the tertiary transferring bias. Thus, four color toner images formed on the second transferring belt 7 undergo tertiary transfer on the third intermediate transferring part 9.

The four color toner images which are visible images formed on the second intermediate transferring part 7 undergo tertiary transfer onto the third intermediate transferring part 9 in the tertiary transferring nip. Residual toner which is not transferred onto the third intermediate transferring part 9 is adhered on the second transferring belt 7 after the second transferring belt 7 passes through the third transferring nip.

This toner is removed by a cleaning device 14 of the second intermediate transferring part shown in FIG. 2 and provided downstream of the third transferring part. The cleaning device 14 of the second intermediate transferring part may be a mechanical cleaner such as a cleaning blade or an electrostatic cleaner.

The second intermediate transferring part 7 includes a separating part such as a link mechanism not illustrated in FIG. 1. The separating part is configured to separate the second intermediate transferring part 7 from the first intermediate transferring part 5 and the third intermediate transferring part 9.

Because of this, it is possible to separate the second intermediate transferring part 7 from the first intermediate transferring part 5 and the third intermediate transferring part 9 in a case other than a case where the second intermediate transferring part 7 from the first intermediate transferring part 5 and the third intermediate transferring part 9 should come in contact with each other such as at the time of adjusting density or coloring or at the time of both surfaces printing.

A fourth transferring roller 10 is provided above the third intermediate transferring part 9 so as to sandwich the conveyance path 16 of the transferring medium with the third intermediate transferring part 9. The fourth transferring roller 10 comes in contact with the third intermediate transferring part 9 so as to be rotated with the third intermediate transferring part 9 clockwise in this example.

A quaternary transferring nip is formed by contact of the third intermediate transferring part 9 with the fourth transferring roller 10. A position of the quaternary transferring nip is a fourth transferring part. A quaternary bias having a polarity reversed against the polarity of the toner is applied to the fourth intermediate transferring part 10 side.

The fourth intermediate transferring part 10 has conditions proper for performing electrostatic transferring by the quaternary transferring bias. Thus, four color toner images formed on the third intermediate transferring part 9 are quaternary transferred on the transferring medium conveyed on the conveyance path 16.

Four color toner images which are visible images formed on the third intermediate transferring part 9 are transferred onto the rear surface of the transferring medium in the quaternary transferring nip. Residual toner which is not transferred onto the rear surface of the transferring medium is adhered on the third intermediate transferring part 9 after the third intermediate transferring part 9 passes through the fourth transferring nip.

This toner is removed by a cleaning device 15 of the third intermediate transferring part shown in FIG. 2 and provided downstream of the fourth transferring part. The cleaning device 15 of the third intermediate transferring part may be a mechanical cleaner such as a cleaning blade or an electrostatic cleaner.

Figure 3:
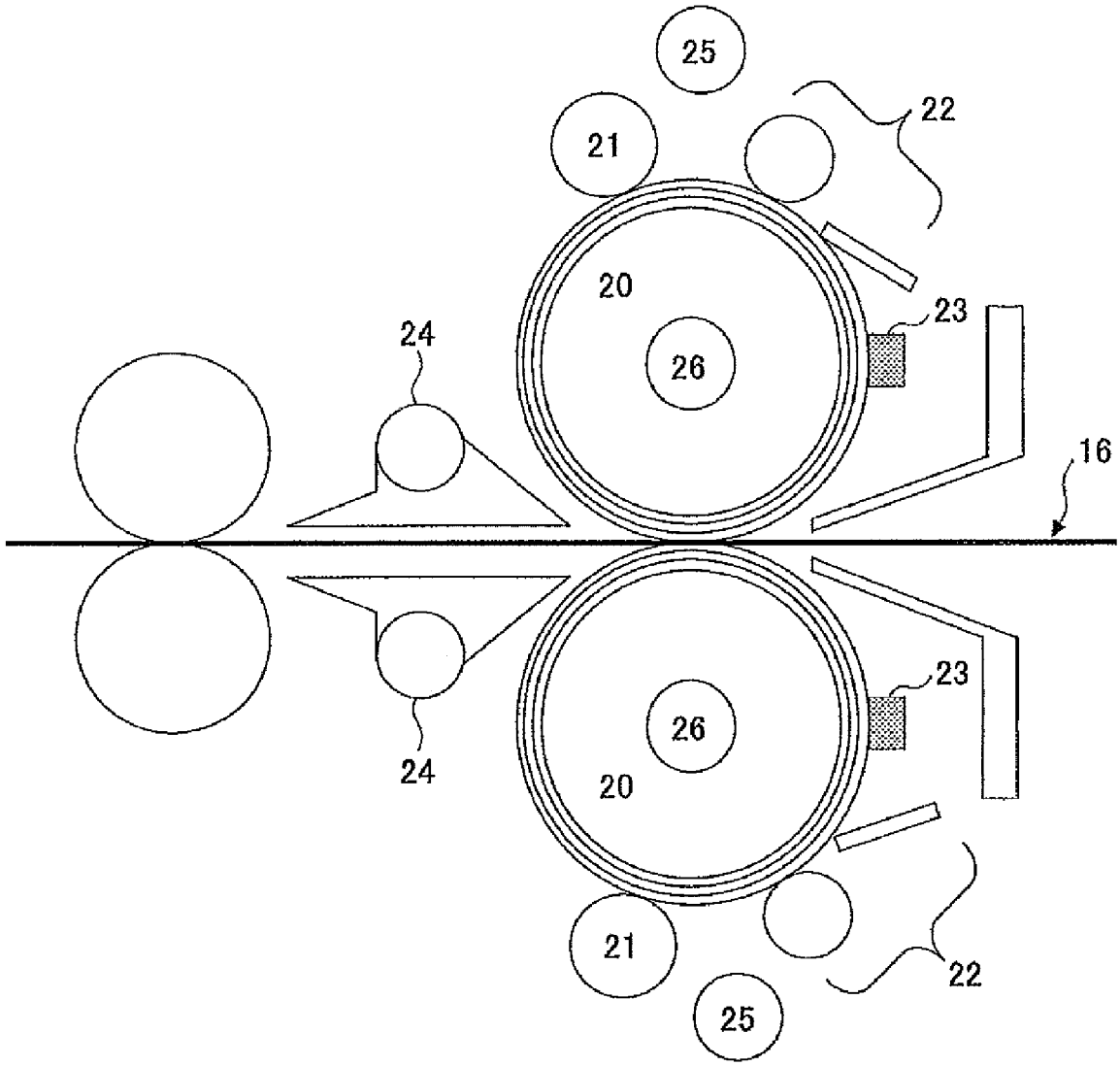
FIG. 3 is a schematic structural view of a fixing device of the image forming apparatus of the embodiment of the present invention.

The transferring medium having both surfaces where the toner images are transferred is further conveyed along the conveyance path 16 so as to be conveyed to a fixing device shown in FIG. 3. Here, FIG. 3 is a schematic structural view of a fixing device of the image forming apparatus of the embodiment of the present invention.

The fixing device includes two fixing rollers. Any of the rollers includes heat generation parts such as halogen lamps. The transferring medium sandwiched by a fixing nip is heated from both surfaces. By this heating, full color images formed on both surfaces of the transferring medium are fixed on the transferring medium due to softening of the toners forming the full color images. The full color images on both the surfaces are fixed by a single fixing operation in a stretch. Because of this, heating the toner is required only one time and exuding or delamination (toner offset) due to unnecessary softening of the toner may not happen. The transferring medium after the fixing is discharged to outside the apparatus via discharge rollers or the like.

Surface temperatures of the two fixing rollers are detected by a temperature detecting part. An ON/OFF switch for electric power supplied to the heat generation part of each fixing roller is controlled based on the detection result of the surface temperature detected by the temperature detecting part, so that the surface temperature of the fixing roller is maintained in a certain range (target range).

In a case where an image is formed on only a single surface of the transferring medium, it is possible to fix the image with an amount of heat smaller than that in a case of both-surface printing. Accordingly, in the case of the single surface printing, it is possible to save energy if the surface temperature is made lower than the target range of the surface temperature in the case of the both-surfaces printing. Furthermore, the amount of the toner in the case of the single color image is made smaller than that in the case of the full color image. Accordingly, it is possible to save energy if the target range of the surface temperature is switched at the time of the single color printing and the full color printing.

Here, a schematic structure of the fixing device is discussed with reference to FIG. 3. Layers of materials having small surface roughness and high releasability such as RTV silicon rubber layers are formed on cored bar parts of a pair of (upper and lower) fixing rollers 20. Heaters 26 are provided inside the cored bar parts.

Since the surface parts are made of the materials having high releasability and small surface roughness so that good smoothness is obtained, even if a toner image of a color toner having a low softening temperature for high color reproducibility is formed on the transferring medium, it is possible to fix the color toner image on both the surfaces of the transferring medium in an excellent manner. It is preferable that the surface roughness of the fixing roller 20 be equal to or less than 4 μm of Rz of JIS 10 points average. Approximately 2 μm is more preferable.

Cleaning members 21, oil supplying members 22, temperature detecting members 23, exfoliation claws 24, temperature excessively increasing prevention members 25, and other parts are provided. In the fixing device of the embodiment of the present invention, upper and lower fixing rollers 20 are made of the same components and various members provided in the vicinities of the upper and lower fixing rollers 20 are commonly used. Hence, it is possible to achieve low cost.

In the case of the single printing, the fourth transferring part does not work. However, in the fourth transferring part, at the time of the single printing, the toner image provided but not fixed on the surface of the transferring medium comes in contact with the fourth transferring roller 10 so that the toner image on the surface of the transferring medium may be disordered. Accordingly, in this example, a separating part configured to contact and separate the fourth transferring roller 10 and the third intermediate transferring part 9 each other is provided. Because of this, by separating the surface of the transferring medium and the fourth transferring roller 10 from each other at the time of single printing, it is possible to prevent a disordered situation of the toner image on the surface of the transferring medium.

In the fourth transferring part, when quaternary transferring bias having a polarity reversed against the polarity of the toner is applied to the fourth transferring roller 10 at the time of both-surfaces printing, the four color toner image formed on the surface of the transferring medium is reverse transferred onto the fourth transferring roller 10 so that the toner image on the surface of the transferring medium is disordered.

Because of this, in the conveyance path 16 of the transferring medium in FIG. 1, a pre-fixing device 17 is provided between the first transferring nip part of the first transferring part 6C situated most downstream of the first transferring parts and the fourth transferring nip part. The pre-fixing device 17 is configured to fix the toner image on the surface of the transferring medium.

In the pre-fixing device 17, fixing may be achieved so that reverse transferring to the fourth transferring roller 10 does not occur even if the quaternary transferring bias is applied. Hence, it is possible to make the target range of the surface temperature of the fixing roller low. Instead of such a heating type pre-fixing device 17, a pre-fixing part for pre-fixing by pressing the toner image on the surface of the transferring medium or a pre-fixing part formed by combining the heating type pre-fixing device 17 and the above-mentioned pre-fixing part for pre-fixing by pressing, may be used.

In the fourth transferring part, by using a non-contact type transferring charger instead of the fourth transferring roller 10, it is possible to transfer the four color toner images to the rear surface of the transferring medium without the pre-fixing device while the disorder of the toner image on the surface of the transferring medium is prevented.

In the case of the both surface printing, first, a toner image for a rear surface of the transferring medium is formed on the image carrier 1. The transferring medium is conveyed along the conveyance path 16 to the fourth transferring part based on the timing when the toner image for the rear surface arrives at the fourth transferring part, which is a transferring position on the rear surface via the first intermediate part 5, the second intermediate part 7, and the third intermediate part 9. A toner image for the front surface is formed on the image carrier 1 so that the toner image is transferred onto the front surface of the transferring medium in the first transferring part. Thus, the toner images are positioned on the front and rear surfaces of the transferring medium.

In this case, if the length in a sub-scanning direction of a single toner image to be formed is too long, the head end of the toner image arrives at the fourth transferring part while the rear end of the toner image on the rear surface is being formed on the image carrier 1. As a result of this, the head of the toner image is not formed on the front surface so that positioning of the toner image on the surface and the rear surface is not properly accomplished.

A maximum paper length "L" in the sub-scanning direction of the image formed on the rear surface of the transferring medium at the time of both surface printing is expressed as follows, where "L1" represents a distance from the first transferring part to the fourth transferring part of Bk on the conveyance path 16 of the transferring medium, and "L2" represents a distance from the first transferring part to the fourth transferring part of Bk in the moving distance of the toner image.

$$L=L2-L1$$

The maximum paper length "L" in the sub-scanning direction at the time of both surface printing is stored in an inside memory in advance. In a case where the both-surfaces printing is instructed by the user, "L" and the length of the paper for which paper instructions are made are compared.

If the length of the paper for which paper instructions are made is greater than "L", a printing error may be displayed or the image forming apparatus may be stopped.

According to the image forming apparatus of the embodiment of the present invention, direct transferring is performed from the image carrier to the surface (front surface) of the transferring medium and intermediate transferring is performed to the rear surface of the transferring medium via three intermediate transferring parts. Hence, it is possible to provide a small size image forming apparatus at low cost where high quality images can be formed on both surfaces of the transferring medium.

In the image forming apparatus of the embodiment of the present invention, at the time of single surface printing, the fourth transferring roller 10 coming in contact with the toner image transferred on the surface of the transferring medium is separated from the transferring medium. As a result of this, degradation of the toner image due to the contact of the non-fixed toner image and the fourth transferring roller 10 can be prevented.

In the image forming apparatus of the embodiment of the present invention, after the transferring on the front surface of the transferring medium, the pre-fixing is performed. Accordingly, at the time of transferring the toner image on the rear surface of the transferring medium, it is possible to prevent reverse transferring of the toner image on the front surface of the transferring medium to the fourth transferring roller 10.

In the image forming apparatus of the embodiment of the present invention, it is possible to prevent reverse transferring of the toner image on the front surface of the transferring medium by using a non-contact type transferring part such as a transferring charger for transferring the toner image on the rear surface of the transferring medium.

In the image forming apparatus of the embodiment of the present invention, it is possible to prevent a rear stain due to the residual toner on the first intermediate transferring part at the time of transferring the toner image on the front surface of the transferring medium, by using a toner cleaning part such as the cleaning blade on the first intermediate transferring part.

In the image forming apparatus of the embodiment of the present invention, it is possible to prevent degradation of the toner image due to the residual toner on the second intermediate transferring part at the time when the toner image is transferred on the second intermediate transferring part by using a toner cleaning part such as the cleaning blade on the second intermediate transferring part.

In the image forming apparatus of the embodiment of the present invention, it is possible to prevent degradation of the toner image due to the residual toner on the third intermediate transferring part at the time when the toner image is transferred on the rear surface of the transferring medium by using a toner cleaning part such as the cleaning blade on the third intermediate transferring part.

In the image forming apparatus of the embodiment of the present invention, it is possible to prevent a rear stain due to the residual toner on the second intermediate transferring part, by separating the second intermediate transferring part from the first intermediate transferring part and the third intermediate transferring part at the time of a single surface printing.

In the image forming apparatus of the embodiment of the present invention, it is possible to easily adjust density or coloring of the toner image on the surface (front surface) and the image on the surface (rear surface) by separating the second intermediate transferring part from the first intermediate transferring part and the third intermediate transferring part at the time of adjusting the density or coloring. Especially, since the toner image is formed on the first intermediate transferring part under the same conditions as the surface of the transferring medium, it is possible to easily adjust density or coloring of the toner image on the surface of the transferring medium with high densities.

In the image forming apparatus of the embodiment of the present invention, it is possible to determine the maximum paper length wherein the both surface printing can be performed by storing the difference between the moving distance from the first transferring part to the fourth transferring part of the toner image and the conveyance distance from the first transferring part to the fourth transferring part of the transferring medium. As a result of this, it is possible to prevent problems which cause abnormal images due to overlapping forming the toner images on the front surface and the rear surface.

Thus, according to the embodiment of the present invention, it is possible to provide an image forming apparatus that forms a high quality image on both surfaces of the transferring medium by a one-pass method and to realize simplification of the apparatus.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

This patent application is based on Japanese Priority Patent Application No. 2008-15488 filed on Jan. 25, 2008, the entire contents of which are hereby incorporated herein by reference.

What is claimed is:

1. An image forming apparatus, comprising:

a latent image forming part configured to form a latent image on an image carrier;

a developing part configured to form a toner image by developing the latent image on the image carrier;

a first transferring part configured to transfer the toner image on the image carrier to a first surface of a transferring medium having two surfaces including the first surface and a second surface and configured to transfer the toner image to a first intermediate transferring part;

a second transferring part configured to transfer the toner image on the first intermediate transferring part onto a second intermediate transferring part;

a third transferring part configured to transfer the toner image on the second intermediate transferring part onto a third intermediate transferring part; and a fourth transferring part configured to transfer the toner image on the third intermediate transferring part and indirectly from the first transferring part onto the second surface of the transferring medium without reversing the transferring medium on a conveyance path of the transferring medium after the toner image is directly transferred from the first transferring part to the first surface of the transferring medium to carry out both-surface printing;

wherein the first intermediate transferring part and the second intermediate transferring part are belt shaped;

the third intermediate transferring part is roller shaped; and the fourth transferring part is provided at a downstream side of the first transferring part on the conveyance path of the transferring medium.

2. The image forming apparatus as claimed in claim 1, further comprising:

a transferring nip formed by contact of the third intermediate transferring part with the fourth transferring part and configured to apply a voltage causing a polarity opposite to a toner's polarity to the fourth transferring part.

3. The image forming apparatus as claimed in claim 1, wherein a pre-fixing part is provided between the first transferring part and the fourth transferring part on the conveyance path.

4. The image forming apparatus as claimed in claim 1, wherein the fourth transferring part is a non-contact type transferring part.

5. The image forming apparatus as claimed in claim 1, further comprising:

a cleaning device configured to clean the first intermediate transferring part, the first intermediate transferring part being the part from which the toner image is transferred onto the second intermediate transferring part by the second transferring part.

6. The image forming apparatus as claimed in claim 1, further comprising:

a cleaning device configured to dean the second intermediate transferring part, the second intermediate transferring part being the part from which the toner image is transferred onto the third intermediate transferring part by the third transferring part.

7. The image forming apparatus as claimed in claim 1, further comprising:

a cleaning device configured to dean the third intermediate transferring part, the third intermediate transferring part from which the toner image is transferred on the transferring medium by the fourth transferring part.

8. The image forming apparatus as claimed in claim 1, further comprising:

a toner image detecting part configured to detect density and transferring position of the toner image transferred onto the first intermediate transferring part.

9. The image forming apparatus as claimed in claim 1, further comprising:

a storage device configured to store a maximum length of the transferring medium where the toner image can be transferred, the maximum length being calculated by a moving distance of the toner image from the first transferring part to the fourth transferring part in the first intermediate transferring part, the second intermediate transferring part, and the third intermediate transferring part, and a distance from the first transferring part to the fourth transferring part on the conveyance path.

10. An image forming apparatus, comprising:

latent image forming means for forming a latent image on an image carrier;

developing means for forming a toner image by developing the latent image on the image carrier;

first transferring means for transferring the toner image on the image carrier to a first surface of a transferring medium having two surfaces including the first surface and a second surface and configured to transfer the toner image to a first intermediate transferring part;

second transferring means for transferring the toner image on the first intermediate transferring part onto a second intermediate transferring part;

third transferring means for transferring the toner image on the second intermediate transferring part onto a third intermediate transferring part; and fourth transferring means for transferring the toner image on the third intermediate transferring part and indirectly from the first transferring means onto the second surface of the transferring medium without reversing the transferring medium on a conveyance path of the transferring medium after the toner image is directly transferred from the first transferring means to the first surface of the transferring medium to carry out both-surface printing;

wherein the first intermediate transferring part and the second intermediate transferring part are belt shaped;

the third intermediate transferring part is roller shaped; and the fourth transferring means is provided at a downstream side of the first transferring means on the conveyance path of the transferring medium.

* * * * *